US010982834B2

(12) United States Patent
Jurek et al.

(10) Patent No.: US 10,982,834 B2
(45) Date of Patent: Apr. 20, 2021

(54) THERMAL CONTROL OF LOCOMOTIVE HEADLIGHT

(71) Applicant: Smart Light Source Co., LLC, Brooklyn, NY (US)

(72) Inventors: Brian Jurek, Austin, TX (US); Agron Madzar, Brooklyn, NY (US); Byron Ziegler, Austin, TX (US)

(73) Assignee: SMART LIGHT SOURCE CO., LLC, Brooklyn, NY (US)

( * ) Notice: Subject to any disclaimer, the term of this patent is extended or adjusted under 35 U.S.C. 154(b) by 0 days.

(21) Appl. No.: 16/193,435

(22) Filed: Nov. 16, 2018

(65) Prior Publication Data

US 2019/0154229 A1 May 23, 2019

Related U.S. Application Data

(60) Provisional application No. 62/587,729, filed on Nov. 17, 2017.

(51) Int. Cl.

| | |
|---|---|
| ***F21S 45/48*** | (2018.01) |
| ***F21V 23/00*** | (2015.01) |
| ***F21V 29/503*** | (2015.01) |
| ***F21V 29/508*** | (2015.01) |
| ***F21V 31/00*** | (2006.01) |
| ***F21V 15/04*** | (2006.01) |
| ***F21V 29/76*** | (2015.01) |
| ***B61D 29/00*** | (2006.01) |
| ***F21V 29/80*** | (2015.01) |

(Continued)

(52) U.S. Cl.

CPC ..... *F21S 45/48* (2018.01); *B61D 29/00* (2013.01); *F21V 15/04* (2013.01); *F21V 23/003* (2013.01); *F21V 23/005* (2013.01); *F21V 29/503* (2015.01); *F21V 29/508* (2015.01); *F21V 29/763* (2015.01); *F21V 29/767* (2015.01); *F21V 29/80* (2015.01); *F21V 31/005* (2013.01); *F21V 5/007* (2013.01); *F21V 7/0083* (2013.01); *F21Y 2105/18* (2016.08); *F21Y 2115/10* (2016.08)

(58) Field of Classification Search

CPC ..... F21V 29/80; F21V 29/503; F21V 29/763; F21S 45/48; B61D 29/00

See application file for complete search history.

(56) References Cited

U.S. PATENT DOCUMENTS 268,027 A 11/1882 Kirby, Jr.
7,626,345 B2 * 12/2009 Young ..... H05B 33/0866 315/291

(Continued)

FOREIGN PATENT DOCUMENTS

AU 2011101305 A4 11/2011

*Primary Examiner* — Julie A Bannan

(74) *Attorney, Agent, or Firm* — Venable LLP; Michele V. Frank

(57) ABSTRACT

A locomotive headlamp assembly for the thermal control and/or thermal management of heat in a LED lamp enclosure is provided. A seamless retrofit is provided for existing Incandescent (Quartz Halogen) lamps that are in current use. The thermal control of the locomotive headlight generally includes a headlight that has the ability to replace existing Incandescent (Quartz Halogen) lamps with the energy savings of LEDs using interactive circuitry to maximize performance and energy savings and also the thermal management to ensure longer life on LEDs.

25 Claims, 14 Drawing Sheets

(51) Int. Cl.

| | |
|---|---|
| *F21Y 115/10* | (2016.01) |
| *F21V 7/00* | (2006.01) |
| *F21V 5/00* | (2018.01) |
| *F21Y 105/18* | (2016.01) |

(56) References Cited

U.S. PATENT DOCUMENTS

| | | | | |
|---|---|---|---|---|
| 8,946,989 | B2 | 2/2015 | McWithey | |
| 9,188,307 | B2 * | 11/2015 | Casper | F21V 15/012 |
| 9,499,180 | B2 | 11/2016 | Donnan et al. | |
| 2009/0066266 | A1 * | 3/2009 | Jungwirth | H05B 33/0815 315/307 |
| 2010/0282446 | A1 * | 11/2010 | Yamamoto | F21S 8/02 165/109.1 |
| 2011/0211351 | A1 * | 9/2011 | Van De Ven | F21V 29/70 362/249.02 |
| 2013/0051045 | A1 | 2/2013 | Kay | |
| 2014/0126214 | A1 * | 5/2014 | Gebhard | F21V 29/02 362/294 |
| 2015/0109793 | A1 * | 4/2015 | Dingemans | F21V 5/10 362/294 |
| 2015/0153033 | A1 * | 6/2015 | Kuo | F21K 9/00 362/311.02 |
| 2015/0367865 | A1 | 12/2015 | Donnan et al. | |
| 2016/0374173 | A1 * | 12/2016 | Vidal | H05B 33/0803 |
| 2017/0234503 | A1 * | 8/2017 | Buffone | F21S 41/141 362/509 |

* cited by examiner

THERMAL CONTROL OF LOCOMOTIVE HEADLIGHT

CROSS-REFERENCE TO RELATED APPLICATIONS

This application claims priority to U.S. Provisional Patent Application No. 62/587,729 filed Nov. 17, 2017, herein incorporated by reference in its entirety.

TECHNICAL FIELD

The present invention relates generally to locomotive headlights and, more specifically, to a thermal control of a locomotive headlight for the thermal management of heat in a LED lamp enclosure.

BACKGROUND OF THE INVENTION

Currently, in headlight development, lamps, such as, Quartz Halogen PAR56 is being replaced with LED technology. The development of smaller and more powerful LEDs has enabled a more compact headlight that can now match the candela light output required by the railroad industry. However, LED replacement lights require changes and alterations to the locomotive fixture and locomotive electronics, due in part to the fluctuating voltage and conditions of the locomotive. Thus, a need exists for a LED headlight that can adapt as a retrofit without changes to the locomotive fixture and locomotive electronics. That is, a need exists for a LED headlight that is stable with the fluctuating voltage and conditions of the locomotive. A need further exists for an assembly including removal of heat from the sensitive electronics and LEDs in the headlight.

BRIEF SUMMARY OF THE INVENTION

According to an embodiment, a luminaire comprising: a set of multiple LEDs; circuitry comprising optics and drive electronics; and an enclosure housing the set of multiple LEDs and circuitry with the optics and drive electronics, the enclosure configured to transfer heat from the set of multiple LEDs and circuitry with the optics and drive electronics, wherein the enclosure is configured to transfer heat out of the enclosure and into a surrounding environment.

According to an embodiment, the set of multiple LEDs have an optical path and wherein the enclosure extends longitudinally outward, along the optical path, into the surrounding environment, wherein the enclosure provides greater heat transfer into the surrounding environment than a bowl that is shallower than the enclosure.

According to an embodiment, the heat is transferred to external environment by conduction, convection and radiation.

According to an embodiment, the heat is transferred from the LED (i) through a forward heat sink, (ii) through the enclosure, and (iii) through a rear heat sink, wherein the forward heat sink and the rear heat sink each comprise a plurality of pins.

According to an embodiment, power printed circuit board that includes the LEDs and power drive electronics for unified heat management; and a small signal printed circuit board containing control electronics.

According to an embodiment, small signal components of the power drive electronics are integrated onto additional layers of the power printed circuit board.

According to an embodiment, the power drive electronics are packed between the LEDs off of a heat sink in a direction of an optical path of the LED compared to heat sinking components.

According to an embodiment, the power drive electronics and LEDS are densely packed in the enclosure without compromising the major heat path out a back of the set of LEDs into the heat sinking component (enclosure).

According to an embodiment, the enclosure is sealed from the surrounding environment.

According to an embodiment, external features and structure having a surface area configured to move heat into the surrounding environment and having structure insensitive to mounting orientation rotation along an optical path of the set of LEDs.

According to an embodiment, structural protective ring configured to protect the luminaire from side impact.

According to an embodiment, structural protective ring surrounds an exterior portion of the enclosure.

According to an embodiment, a cast aluminum heat sink and wherein the structural protective ring is 1) an integral part of the cast aluminum heat sink or 2) an added feature mounted to the heat sink with fasteners.

According to an embodiment, structural protective ring has a height configured to protect a lens of the luminaire from a side impact.

According to an embodiment, the structural protective ring has a thickness configured to withstand a side impact.

According to an embodiment, the luminaire has cutaways configured to compensate for an added weight of the structural protective ring, wherein the cutaways are one or more of slots, ovals, circles and grooves.

According to an embodiment, a conformal heat sink for heat transfer from a metal core board located in close proximity to the LEDs, wherein the conformal heat sink follows a shape of a reflector of the luminaire and transfers heat through the enclosure to external ambient air pins.

According to an embodiment, a normal light output of the set of LEDs diminishes over time and is counterbalanced with incremental increases of electrical power to maintain an operational candela requirement, wherein the controlled increase of LED power also controls the heat load on the system.

According to an embodiment, the circuitry configured to include small signal logic comprising at least one of a microcontroller, control logic equivalent, analog to digital converter, digital to analog converter, nonvolatile data memory for code storage and execution, nonvolatile data storage for storing calibration data, nonvolatile data storage capability for real time data collection, constant current controller responsive to the microcontroller for modulating load current, or a current switching device to add current load for source resistance calculation, wherein the current switching device is isolated from input filter reactance.

According to an embodiment, the inputs to the analog to digital converter include input voltage, LED run voltage, LED run current and temperature sensing element.

According to an embodiment, the LED output signals out of tolerance or error conditions under power up or a triggering condition provided via an input power.

According to an embodiment, a power source sampling device to signal data out to a monitoring device or to other luminaires via the input power lines, the power source sampling device configured to generate extra heat for the purpose of melting ice and snow.

According to an embodiment, in response to out of tolerance or error conditions, the circuitry alters the light output of the LEDs to affect the safety and continued operation of the luminaire.

According to an embodiment, further comprising communicating data collected to the outside world with the flashing of the LEDs upon external prompt or a preset condition.

According to an embodiment, further comprising communicating to other digital systems by transmitting data through pulsing currents on the power lines to other digital systems.

According to an embodiment, the pulsed currents develop a serial sequence of voltages that are digital both internal and external to the luminaire.

According to the communication is bi-directional in a half-duplex fashion or extended to full duplex via frequency shift encoding/decoding whose frequencies are determined by stored data uniqueness or wherein the information is transmitted and received through wireless communication between luminaires and a receiver external to the locomotive.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
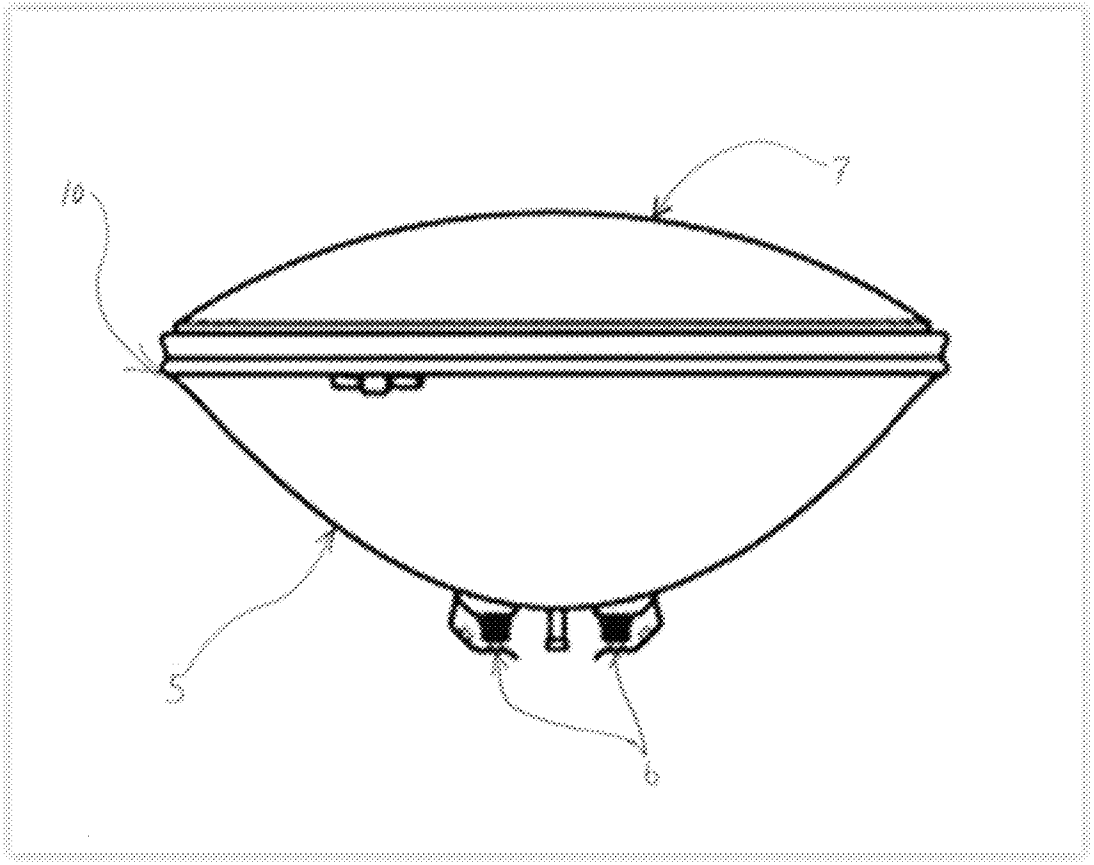
FIG. 1 illustrates a side view of an exemplary PAR56 Incandescent (Quartz Halogen) lamps in accordance with embodiments of the present invention.

Embodiments of the invention are discussed in detail below. In describing embodiments, specific terminology is employed for the sake of clarity. However, the invention is not intended to be limited to the specific terminology so selected. A person skilled in the relevant art would recognize that other equivalent parts can be employed and other methods developed without departing from the spirit and scope of the invention. All references cited herein are incorporated by reference as if each had been individually incorporated.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application. The invention is not limited in its application to the details of construction or to the arrangements of the components set forth in the following description or illustrated in the drawings. The invention is capable of other embodiments and of being practiced and carried out in various ways.

The phraseology and terminology employed herein are for the purpose of the description and should not be regarded as limiting. Some exemplary phrases and terms used herein are as follows:

Retrofit Incandescent (Quartz Halogen) PAR56 Lamps: can refer to an object providing a thermal control of locomotive headlight for the thermal management of heat in LED PAR56 lamp enclosure, and/or a seamless retrofit with the ability to respond to established power settings used for existing Incandescent (Quartz Halogen) PAR56 lamps in current use.

Interactive Intelligent Driver for Thermal Control of Locomotive Headlight: can refer to an object providing a thermal control of locomotive headlight that uses interactive circuitry to give optimum output for the different light outputs (Dim, Medium, High) and simultaneously monitoring the heat environment of the LED chips.

CPC and antireflective coating on glass plate: can refer to an object providing a thermal control of locomotive headlight that uses CPC (Compound Parabolic Concentrator) to direct heat away from LED chips and an antireflective coating to prevent energy being reflected back to the LEDs.

Structural Heatsink with Increased Surface Area: can refer to an object providing a heatsink with an increased surface area that allows for ambient natural convection airflow or forced air to remove thermal energy from the surface of the heatsink.

Structural Protective Ring: can refer to an object providing structural protection using one or more protective rings that protects protruding lamp features from side impact.

The present invention relates generally to LED locomotive headlights and more specifically it relates to a thermal control of locomotive headlight for the thermal management of heat in a LED lamp enclosure. The present invention provides a seamless retrofit for existing PAR56 Incandescent (Quartz Halogen) lamps with the ability to respond to existing locomotive power settings used for Incandescent (Quartz Halogen) PAR56 lamps in current use. The LED locomotive headlight can include a headlight having the ability to replace existing lamps, such as PAR56 Incandescent (Quartz Halogen) lamps, with the energy savings of LEDs using interactive circuitry to maximize performance and energy savings, as well as the thermal management of the LED to ensure longer life of the LEDs. The present invention illustrates lamp positioning on the locomotive includes two upper locomotive headlights that each operate with dim, medium and high light outputs and two auxiliary lights (e.g. ditch lights) located lower than the two locomotive headlights that operate only on a high output.

As described, the headlight assembly of the present disclosure provides for LEDs to be retrofit into an incandescent locomotive headlight. The assembly may have thermal control abilities. That is, the ability to remove, transfer, and/or dissipate heat generated from the LED to the outside environment. The assembly may have an enclosure having structure designed to remove, transfer, and/or dissipate heat from the LEDs. The assembly may have one or more heat sinks oriented in a particular direction to remove, transfer, and/or dissipate heat from the LEDs. The assembly may a lamp shape, such as a parabolic shape/parabolic reflector, to remove, transfer, and/or dissipate heat from the LEDs. The one or more circuit boards of the assembly may remove, transfer, and/or dissipate heat from the LEDs. Any or all of the components of the assembly may be provided with antireflective coating(s) to assist in preventing reflection back to the LED and thus reduce the heat generated.

Three pathways for heat removal can include conduction, convection, and thermal radiation. The thermal control of locomotive headlight can start with infrared heat that is reflected from the LED chip down the optical path using the Compound Parabolic Concentrator (CPC) to direct heat away from LED chips. Another object is an antireflective coating on the optics to prevent energy being reflected back to the LEDs and the energy then exits the optical window.

Internal thermal control of locomotive headlight can employ conduction. The heat can be drawn away from the LED chip through the metal core circuit board and further conduction from the thermally hot area of the metal core board to the conformal heatsink and the metal casting of the housing with the final transfer to the ambient air through convection and thermal radiation.

A structural heat sink with pins can provide heatsink with increased surface area that allows for ambient natural convection airflow or forced air to remove thermal energy from the surface of the heatsink in any orientation. Additionally, optional usage of fins on housing can include diagonal orientation in the metal casting for cooling efficiency to compensate for variations in mounting. A typical PARR56 incandescent lamp can have keys that mate into slots on the mounting surface that ensure orientation. In a pair like the typical headlamp configuration these are placed at 90 degrees to each other to cancel out the optical effect of the shape of the filament, typically horizontal and vertical. Thus, a rectangular array of pins or a diagonal set of linear fins with respect to the mounting pins, is preferred over a straight vertical orientation as it becomes very inefficient convection-wise at moving heat into the surrounding air in the alternate horizontal orientation.

A structural protective ring can provide structural protection using one or more protective rings that protects protruding lamp features from side impact. The protective ring protection can be concentric rings that give further protection and can absorb energy close to each of the optical windows.

The LED lamp can be equipped with circuitry to sense the Thevenin equivalent (analytical abstraction of a linear two terminal circuit comprised of a voltage source and a series impedance) of the circuit that is used to power the lamp and respond optically to that environment in the same way as the obsolete incandescent lamp would have. Additionally this circuitry may sense temperature and conditions for icing that may exist and be used to aid in melting the ice without changing the optical output.

Included in the control circuitry is a readable/writable non-volatile memory to store configuration data, lamp usage data, calibration data, and error condition data. The LED output is affected by temperature and age. Since the lamp hours can be stored, with the control circuitry for example, for cumulative lamp usage and the temperature may be sensed, both temperature and age may be compensated for to produce non-decaying lamp output until end of life. At the end of useful life, the LED headlamp may notify the end user upon power up of stored error codes such as end of life. This enhances safety as the lamp can warn of impending failure without functional degradation.

Turning now descriptively to the drawings, in which similar reference characters denote similar elements throughout the several views, the figures illustrate a headlight that has the ability to replace existing lamps, such as Incandescent (Quartz Halogen) PAR56 lamps, with the energy savings of LEDs, using interactive circuitry to maximize performance and energy savings, as well as thermal management to ensure longer life on LEDs.

Incandescent (Quartz Halogen) lamps operate at a wide range of voltages that give increased lumen output with response to the voltage increase. LEDs have a small voltage range for operation before failure. The invention includes the ability of the LED PAR56 to retrofit an existing locomotive lamp fixture, (defined as the mechanical structure for mounting of lamp and locomotive electronics) without modification to locomotive fixture, using software and circuitry for interactive sensing of variations in voltage that enables the LED lamp to respond to the light output chosen by the conductor (such as Dim, Medium, or High) of the locomotive.

The purpose of the invention is to create a direct LED retrofit for Incandescent (Quartz Halogen) headlamps used in locomotives. To do so, the product must fit within the existing design envelope of the incandescent lamp, in this case the PAR56 lamp.

Referring to FIG. 1 a side view of a PAR56 Incandescent (Quartz Halogen) lamp. The lamp may include a mounting plane or flange 10 that divides the lamp into an interior section 5 and an exterior section 7 with the power terminals 6 attached to the rear portion of the headlight housing. The mounting plane 10 can be the dividing point for the exterior portion of the lamp exposed to the environment 7 and the interior portion of the lamp located in the locomotive lamp fixture 5. In order to accomplish an unmodified installation of the LED, retrofit the installation of LED retrofit must occur without any changes to the existing locomotive lamp fixture (e.g. without changes to the structure of FIG. 1). The LED headlight must not extend beyond the interior profile 5 of the existing PAR56 so that the retrofit lamp can also be used in the confined ditch lamp lighting fixture.

The LED retrofit can install in the same manner as the existing PAR56 Incandescent (Quartz Halogen) and can accept the same type of power within the power limits of the Incandescent (Quartz Halogen) PAR56 lamp. In this case, the LED retrofit can accept a 75 volt direct current at less than 4.7 amperes through two conductors using the same screw or power terminals 6.

The LED retrofit can connect the same way the PAR lamp does. The power leads from the locomotive fixture are not marked as to polarity and this is a not factor in using incandescent lamp which can use either polarity. The LED retrofit can perform with the same characteristics of the PAR56 Incandescent (Quartz Halogen) lamp and connect using either voltage polarity.

In this application, heat is also a problem for all active, passive and ancillary circuit components and attention must be paid to component ratings, and material characteristics. The most demanding characteristic of the locomotive headlight is that LEDs are sensitive to heat as far as lifetime and output is concerned. The headlamp is a challenging environment in which to apply LED technology and particular attention must be paid to the removal of heat from the LED die (chip), and the heat migration path to the external environment.

Another detail is that the lamp must operate in freezing and wet conditions. Freezing may not be a major issue because the luminaire may have a temperature sensor. This temperature sensor, among its other uses, can be used to detect freezing conditions and can override commanded power level till the temperature reaches a threshold that is commensurate with the absence of accumulated snow and ice.

As such, a waterproof enclosure can be provided to prevent water damage of the small signal circuitry and prevent short circuit of the high voltages components. Minerals in the water can deposit on the optics, interfering with the light path (output) and causing unpredictable heating of components. Minerals in the water can also cause the circuit board materials to corrode, opening up current paths and establishing current paths where none existed before. The LED retrofit can have characteristics to tolerate these adverse weather conditions and prevent various failure mechanisms.

In order for the LED retrofit to function as a PAR56, the LEDs can produce a favorable output while providing a heat path away from the semiconductor dies. The LED dies can be small enough to provide a reasonably collimated beam with optics that can fit within the limits of the luminaire's envelope. The optics can be simple and efficient to satisfy the build and market conditions. One aspect of the design is small LED die size that can match the required lumen output. Utilization of multiple smaller LEDs reduces the size of the required optics for a given narrow beam angle.

In addition, there is another benefit with the use of multiple smaller LEDs. The thermal impedance into which the heat flows is smaller for multiple sources in parallel than a single larger source. The thermal peak within the LED die is also reduced by spreading the thermal load over multiple smaller LEDs.

Description Incandescent Quartz Halogen PAR56
Size: 7 Inch Dia×4.500 Inch MOL
Design Wattage 350 W
Design Voltage 75 V
Screw Terminal Base
Tungsten Filament
Overall Length 4.5 Inch
Life 500 h (Incandescent PAR56), 2000 h (Quartz Halogen PAR56)
Locomotive Application Halogen technology extends filament life. The existing PAR56 Incandescent (Quartz Halogen) is varied in power via a 3 way switch and a bank of three power resistors to limit the current to the desired level for generating the three power levels.

The existing PAR56 headlight is paralleled with a similar lamp, presumably for greater output and single point failure not knocking out the headlight completely.

The incandescent lamp does not require defined polarity whereas the LED retrofit drive requires a polar voltage input for the driver electronics. Given the absence of markings on the wiring harness to the lamp, a technician will not be able to nor inclined to determine polarity. The LED headlight must accept and operate with arbitrary input voltage polarity and connection.

The LED headlight can operate with a power rail that is not a regulated source and may apply a persistent and detrimental over-voltage to the LED luminaire. Over time the extra power dissipated in the current controlling switch may cause failure and should not be allowed to continue. In the case of an under voltage, the required currents to maintain the power output could cause overheating and early failure in the rectifying element of the converter and bridge.

Figure 2:
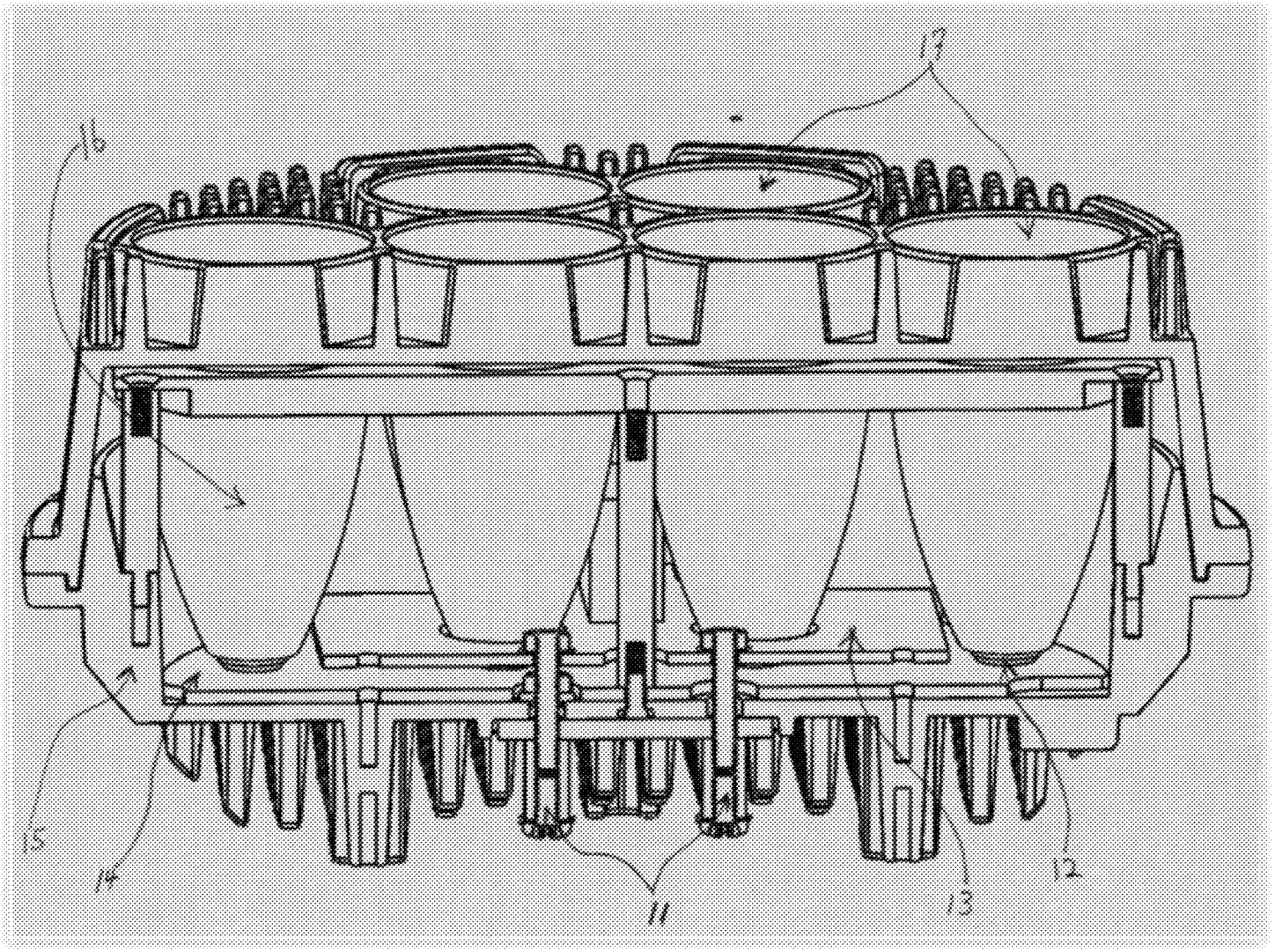
FIG. 2 illustrates a cutaway upper perspective view of an exemplary LED lamp enclosure in accordance with embodiments of the present invention.
Figure 5:
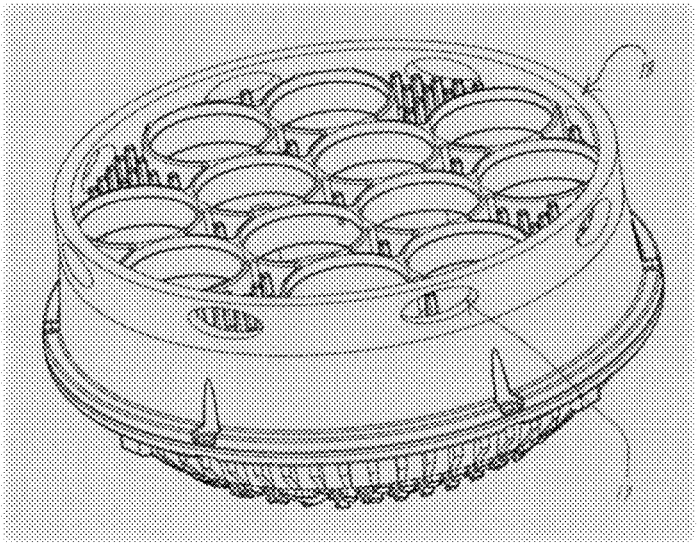
FIG. 5 illustrates an upper perspective view of an exemplary LED enclosure with a protective ring in accordance with embodiments of the present invention.
Figure 6:
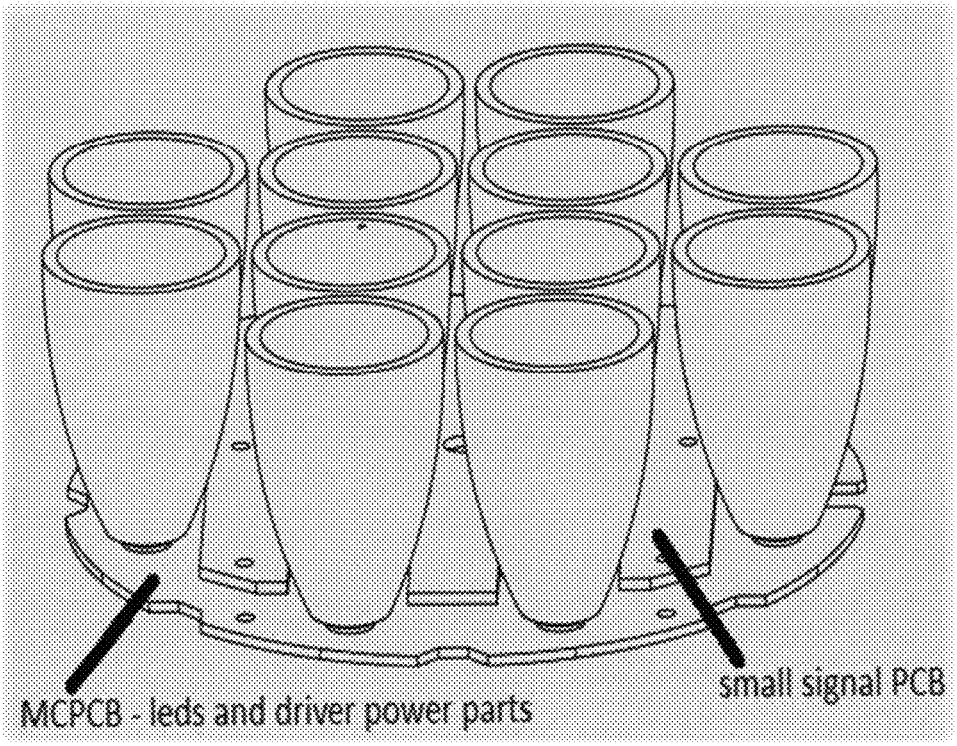
FIG. 6 illustrates an angled side view of an exemplary Metal Core Printed Circuit Board (MCPCB) and Printed Circuit Board (PCB) in accordance with embodiments of the present invention.

FIG. 5 illustrates an upper perspective view of the headlight housing that is provided with a protective ring around the face in order to prevent damage from a side blow. The ring dimensions can vary in size, number of rings and concentricity of the rings across the face of the lamp. FIG. 6 shows an upper perspective view of the small signal printed circuit board with spaces created in the small signal board to accommodate the reflectors mounted on the metal core printed circuit board (MCPCB). FIG. 6 shows the two printed circuit boards for the LEDs and driver with divided into two groups the power components and small signal components. The LEDs and the power components generate considerable heat so the electronic power components are best hosted on a metal core printed circuit board (MCPCB) 14 (FIG. 2). The aluminum MCPCB provides the best heat spreading and path.

Figures 7A, 7B:
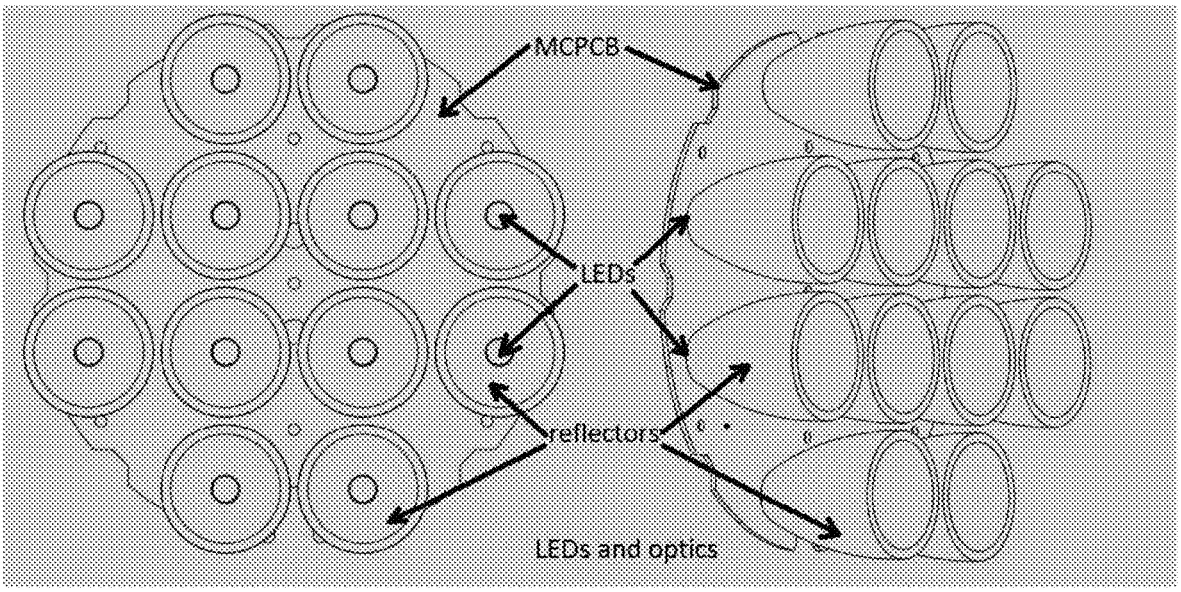
FIGS. 7A and 7B illustrate a top and upper perspective view of exemplary LEDs and optics in accordance with embodiments of the present invention.
Figure 8:
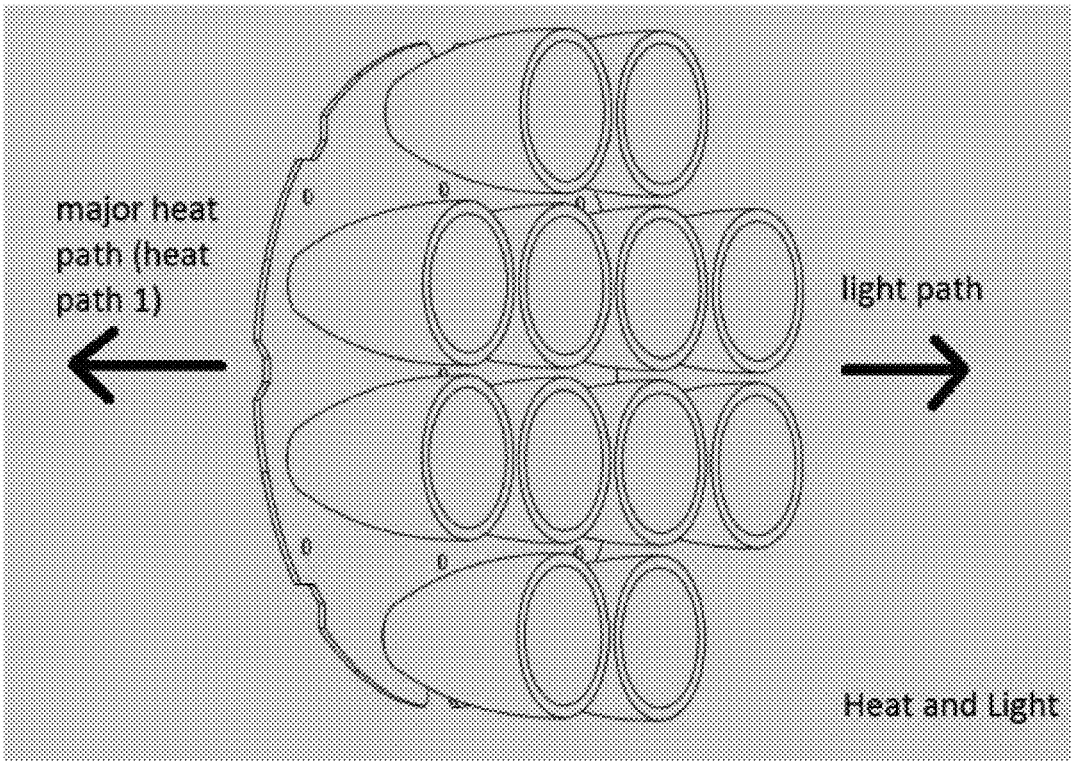
FIG. 8 illustrates an upper perspective view of an exemplary metal core board, optics and major heat path in accordance with embodiments of the present invention.
Figure 9:
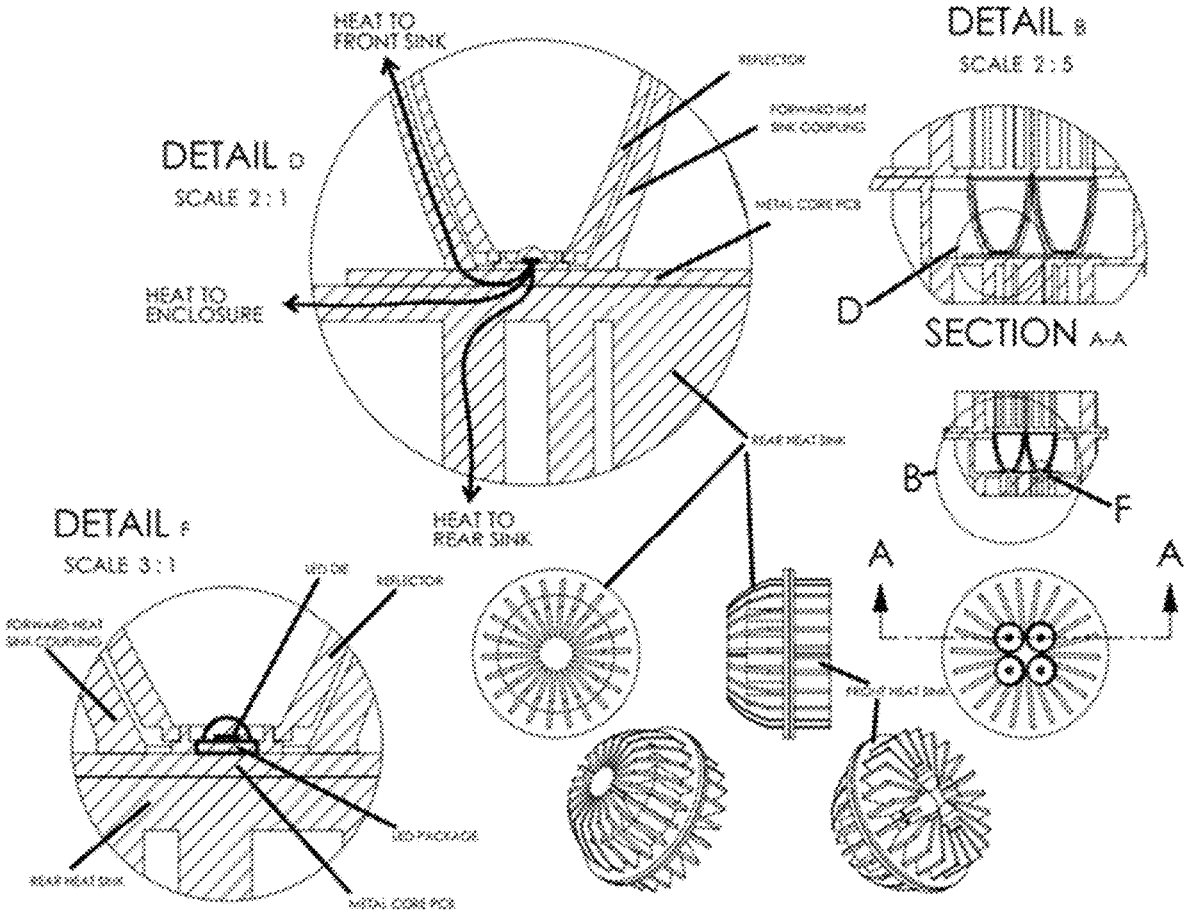
FIG. 9 illustrates various views of a reflector and conformal heat sink in accordance with embodiments of the present invention.

FIG. 7 show a top and upper perspective view of the MCPCB, mounted LEDs from the top view, and CPC reflectors. FIG. 8 shows an upper perspective view of reflectors and circuit board demonstrating the light path and the major direction of the heat path through the MCPCB. FIG. 9 shows a cutaway side view of LED die that is generating heat and the different directions of the heat path first through the MCPCB then to the metal headlight housing and rear heat sink. The heat traveling through the MCPCB also delivers heat to the conformal heat sink that conforms and surrounds the shape of each reflector and directing the path of heat flow to the front heat sink.

The small signal components are more complex and interconnect becomes a problem on the MCPCB due to practical layer limitations and copper thickness requirements. The solution is a standard printed circuit board that is supported off the MCPCB and interconnected via surface mount through-hole male headers that supply both signal and power paths and mechanical support to the fiberglass PCB 13 (FIG. 2). Since the small signal board is perpendicular to the optical plane the small signal PCB must be perforated with holes to allow for light from the LEDs to exit and be collected by the reflectors. This packs the control electronics into the empty space between the reflectors. This provides dense packing and the need for only a single enclosure with its requirement for environmental integrity. It also provides thermal coupling between the heat sensing element in the electronics and the LED junctions. This packing of components provides for a short and direct heat path from the MCPCB to the aluminum enclosure on the opposite side of the LEDs mounted on the MCPCB, and out to external environment for the dissipation of generated heat.

Figure 3:
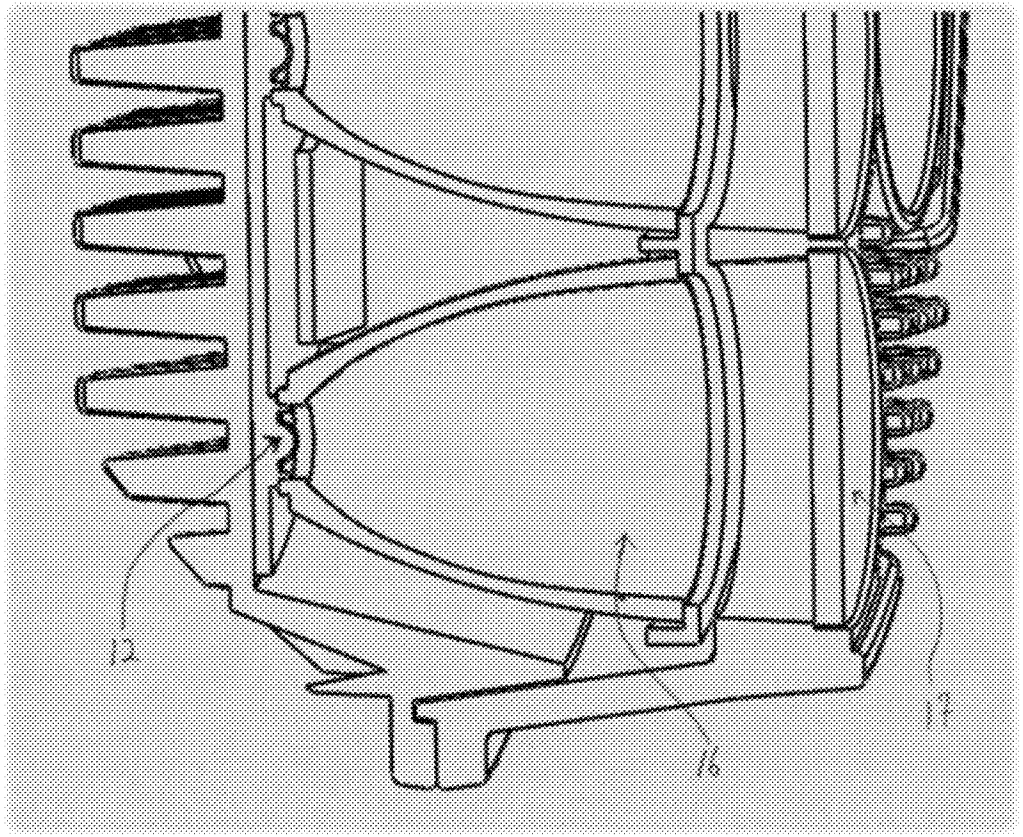
FIG. 3 illustrates a cutaway upper perspective view of an exemplary LED lamp enclosure in accordance with embodiments of the present invention.
Figure 4:
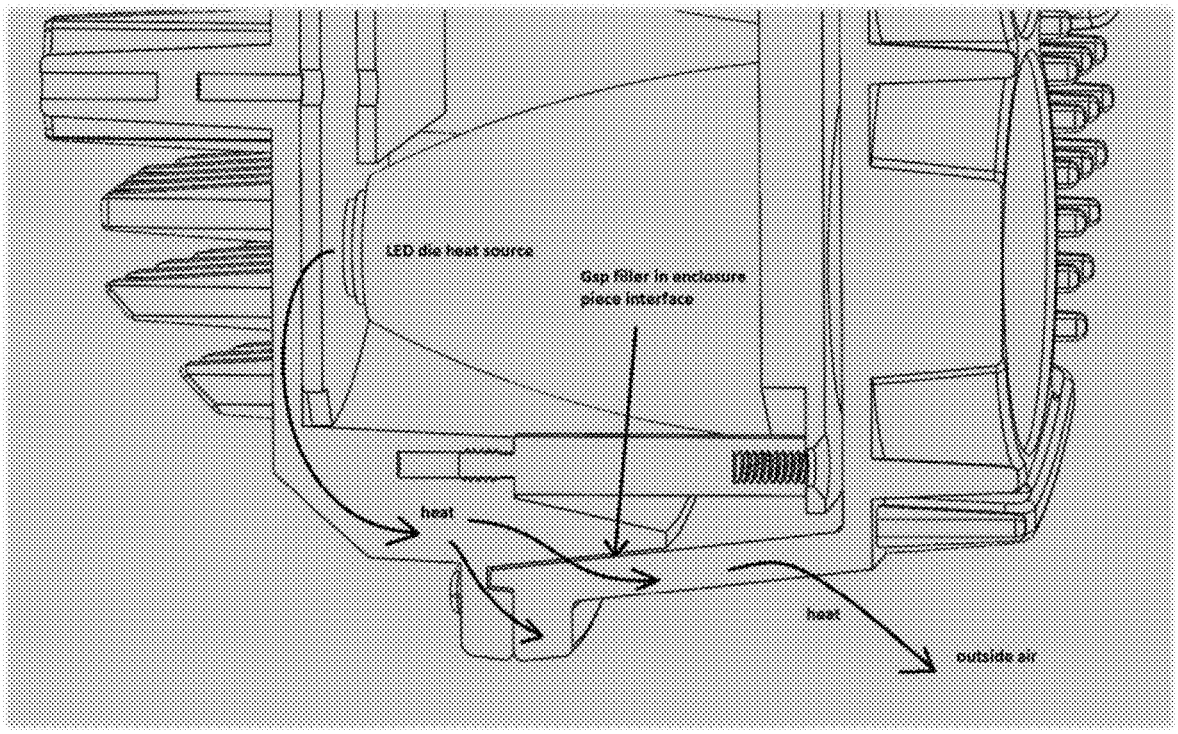
FIG. 4 illustrates a perspective side view of a cutaway profile of mating surfaces in accordance with embodiments of the present invention.

FIG. 3 illustrates a cutaway upper perspective view of the metal headlight housing showing the LED die 12, reflector 16 and the optical lens 17. FIG. 4 shows a perspective side view of the headlight housing demonstrating the heat flow from LED die as the heat source. Heat path is then flowing through the mating metal surfaces and release of heat to the ambient outside air. FIG. 4 shows the heat generated by the LED conducted away from the LED die through the bottom housing and transferred through the friction fit to the upper housing then to the outside ambient air.

Figure 10:
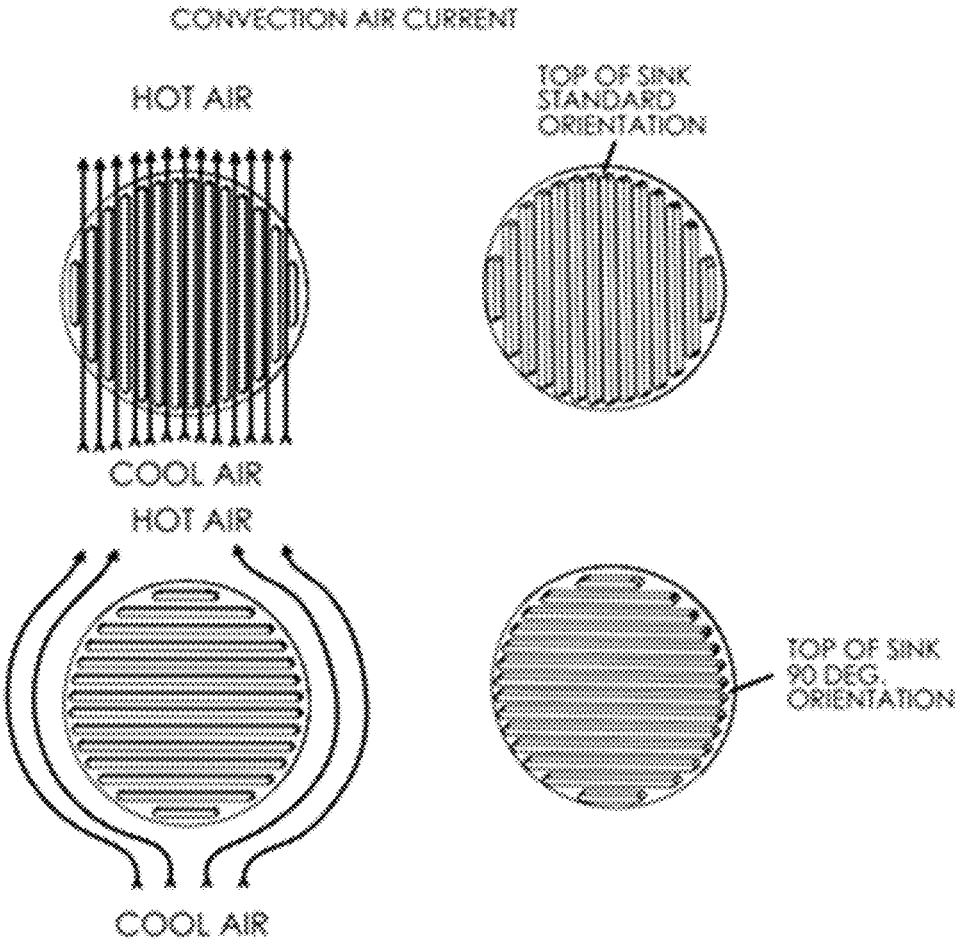
FIG. 10 illustrates a rear view of horizontal and vertical orientation of heat fins in accordance with embodiments of the present invention.
Figure 11:
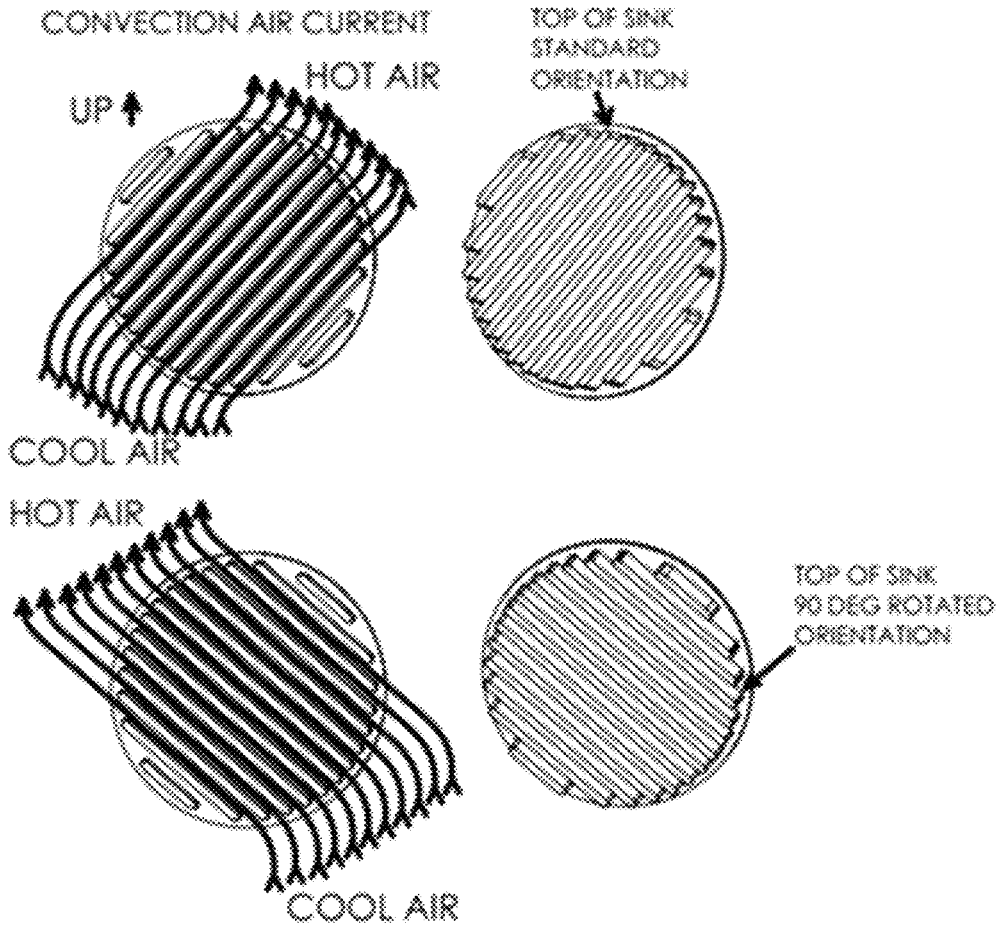
FIG. 11 illustrates a rear view of diagonal heat sink fins in 0 and 90 degrees orientation in accordance with embodiments of the present invention.
Figure 12:
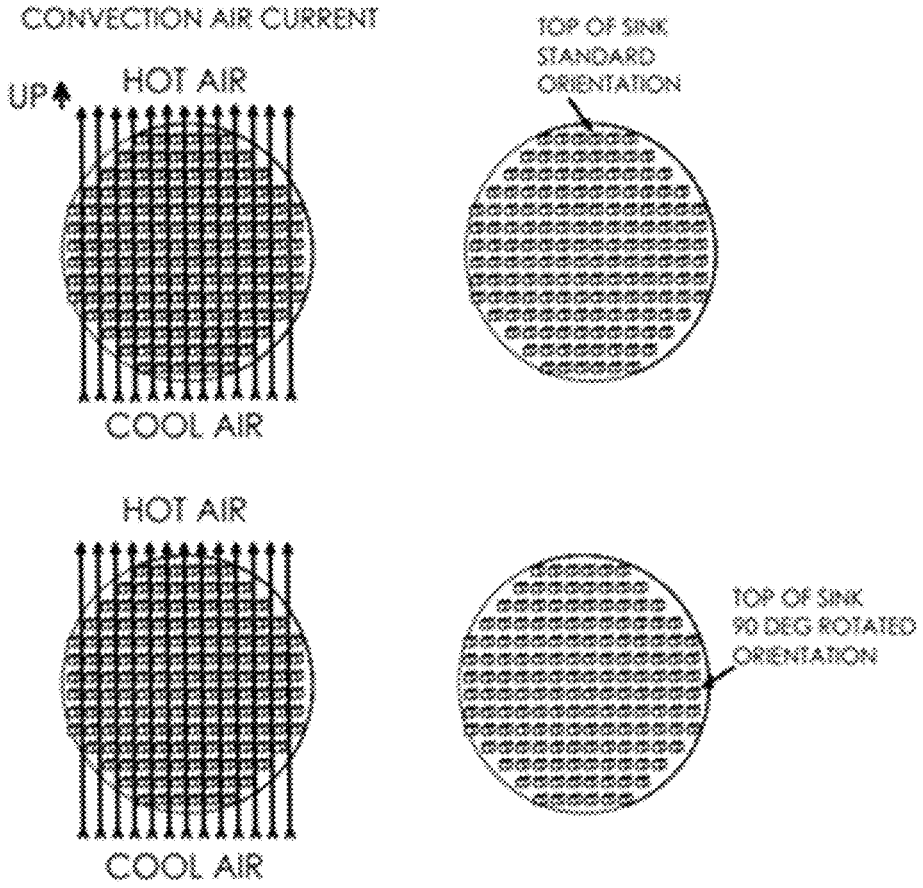
FIG. 12 illustrates a rear view of heat sink pins in 0 and 90 degrees orientation in accordance with embodiments of the present invention.

FIG. 10 shows a rear view of headlight heat sink that shows horizontal and vertical orientation of the heat fins and demonstrates the path of convection air flow. Horizontal orientation does not have the efficiency of the vertical heat sink fins for convection air flow. FIG. 11 shows a rear view of headlight housing heat sink that shows the diagonal heat sink fins in 0 and 90 degrees orientation demonstrating the path of convection air flow is equivalent. FIG. 12 shows a rear view of the headlight housing heat sink with pins in 0 and 90 degrees orientation demonstrating the path of convection air flow is equivalent.

The Enclosure and/or heat sink can keep weather and external pollution out of the optics and electronics as well as providing a path for heat into the outside environment.

a) The enclosure can provide mechanical support for the power entry, drive electronics, optics, and output window. The housing can fit within and couple to the locomotive fixtures that accept standard PAR56 lamps. The housing can fit by the physical configuration and assembly of a variety of shaped materials.

b) The enclosure can provide a means of power entry without exchange of gasses or fluids beyond the barrier. It does so by a conductor insulated with gaskets and/or adhesives and supported by an insulating spacers and hardware. The enclosure can deliver input power to the drive electronics within the enclosure.

c) The enclosure can provide a means of optical energy egress without exchange of gasses or fluids beyond the barrier. This is achieved by a glass or polymer window held in place by mounting rings and sealed by a gasket or adhesives. The enclosure can be rugged enough for the weather and pollution extremes. The enclosure can also play a part in heat management.

d) The enclosure can provide a means of heat removal from the sensitive electro-optical components. The removal of large portion of the thermal load is accomplished by enclosure of cast aluminum. The current arrangement is, but not limited to, two aluminum castings thermally coupled to perform as a single metal structure for the transfer of heat. The shape of the casting is determined by mechanical requirements of the optics, drive electronics and the various means of transferring heat into the external environment.

The mating surface utilizes a gap filling mixture of particulates suspended in a flow medium between the front and back halves of the fixture FIG. 4. This gap filler has the purposes of thermal coupling between the two halves and sealing out gas and liquid migration across its barrier. The enclosure of which is constructed in pieces each coupling to one or more of its counterparts. These mating surfaces have extended surface area to facilitate thermal coupling, and sealing without a gasket.

Heat is moved away from the optics and electronics through their mechanical coupling to the enclosure's interior surface. Heat then travels along the enclosure to all parts of the contiguous metal. The most direct heat path is out the bottom of the lamp enclosure to the metal to air interface surface. The current arrangement is, but not limited to, pins for the dissipation of heat which allows for unrestricted position during operation. FIG. 12 shows the pin heat dissipation surface is configured to maximize air contact at arbitrary rotary orientations (with the beam axis is parallel to the locomotive train tracks) about the beam axis. This places the base of the enclosure perpendicular to the tracks and parallel to the convection path of heated air. Heat removal by convection is maximized by these pins adding surface area with which the air interacts. The pins are no longer than the rear profile 5 (FIG. 1) of the PAR56 Incandescent (Quartz Halogen) lamp.

The aluminum enclosure may be anodized to increase emissivity and increase the effect means of heat transfer to the external environment. This flow of thermal energy from the internal portion of the lamp enclosure is limited by thermal capacity of the locomotive fixture because the fixture of the locomotive is not vented to external environment. The enclosure will dissipate heat until it is in equilibrium with the locomotive fixture. To avoid this limitation of thermal capacity another direction for heat removal is to separate the electronics. The lower heat generating electronics and optics are moved forward to provide for maximum heat spreading around the outlying LED dies and to provide for a heat path into the external air by extending the enclosure into the unobstructed space in the beam path. The wall of the enclosure has pins to maximize interaction with the outside air especially enhanced by the motion of the locomotive.

In the present invention includes all forms of reflectors including the CPC (Compound Parabolic Concentrator) 16 (FIG. 2) has the function to collect the light from the LED die and send the light forward through the protective glass or PC (polycarbonate) lens or plate. Glass or PC lens (aspheric) or plate 17 (FIG. 2) has the ability to reflect 4% to 8% (depending on lens or plate) of the light back from each glass, PC air interface surface to the LED die so the coating of anti-reflective coating and UV coating on the glass or PC surface enables the light to pass forward through the protective glass, PC lens or plate. Using a broadband anti-reflective coating reduces surface reflection of a surface from 4% to less than 0.5%

FIG. 4 illustrates a perspective side view of the headlight housing demonstrating the heat flow from LED die as the heat source. Heat path is then flowing through the mating metal surfaces and release of heat to the ambient outside air. FIG. 5 shows an upper perspective view of the headlight housing that is provided with a protective ring around the face in order to prevent damage from a side blow. The ring dimensions can vary in size, number of rings and concentricity of the rings across the face of the lamp. FIG. 5 shows the structural protective ring that provides protection from side impact. The protective structure surrounding the exterior portion of the lamp enclosure can be an integral part of the cast aluminum heat sink or can be an added feature mounting to the heat sink casing with fasteners. There should be enough height to the ring to protect the lenses from any side impact. Further protection can be added with the use of concentric rings to give further protection that can absorb energy from a side impact. The ring (collar) 18 should be thick enough to withstand the impact. In order to compensate for the added weight cut away of material 19 may be removed without substantial loss of protection from side impact. Cutaways can be slots, ovals, circles 19 or grooves.

Operation of Preferred Embodiment

The invention generally relates to a LED locomotive headlight which includes a headlight that has the ability to replace existing PAR56 Incandescent (Quartz Halogen) lamps (e.g. FIG. 1) with no change or alterations to the existing locomotive fixture. The existing PAR 56 Incandescent (Quartz Halogen) lamp has a lower portion with a parabolic shape 5 (FIG. 1) and power connections 6 and the upper portion 7 that protrudes beyond the mounting support plane 10 into the external environment. The present invention of the disclosed locomotive headlight is designed to optimize the removal of thermal energy from the LED light source. In an exemplary embodiment, the headlamp comprises a lower portion which resides in the locomotive fixture and an upper portion which protrudes to the external environment. The mounting support plane 10 defines the lower portion and upper portion of the LED PAR56 lamp enclosure.

In order to accomplish an unmodified installation of the LED PAR56 lamp, referred to as LED retrofit, the installation of LED retrofit must occur without any changes to the existing locomotive lamp fixture. The LED headlight must not extend beyond the 5 (FIG. 1) interior parabolic profile of the existing PAR56 Incandescent (Quartz Halogen) lamps. Designing the LED retrofit with the parabolic profile allows the retrofit lamp to be utilized in the confined Auxiliary lamp lighting fixture.

The LED retrofit can install with same parameters as the existing PAR56 Incandescent (Quartz Halogen) and must accept the same type of power within the power limits. In this case it must accept a 75 volt direct current at less than 4.7 amperes through two conductors with ring terminals.

The LED retrofit must connect the same way the PAR lamp does using two power terminals. The power leads from the locomotive fixture are not marked as to polarity and this is a not factor in using incandescent lamp which can use either polarity. The LED retrofit must be perform with the same characteristics of the Incandescent (Quartz Halogen) PAR56 lamp and connect using either voltage polarity.

In this application, heat is also a problem for all active, passive and ancillary circuit components with the most demanding characteristic of the locomotive headlight is that LEDs are sensitive to heat as far as lifetime and output is concerned. The headlamp is a challenging environment in which to apply LED technology and particular attention must be paid to the removal of heat from the LED die (chip), and the heat migration path to the external environment.

Waterproof enclosure is needed to prevent water damage of the small signal circuitry and prevent short circuit of the high voltages components. Minerals in the water can also cause the circuit board materials to corrode, opening up current paths and establishing current paths where none existed before. The LED retrofit must have characteristics to tolerate these adverse weather conditions and prevent various failure mechanisms.

In order for the LED retrofit to function as a PAR56 the LEDs must produce a favorable output while providing a heat path away from the semiconductor dies. The LED dies must be small enough to provide a reasonably collimated beam with optics that can fit within the limits of the luminaire's envelope. One aspect of the design is small LED die size that can match the required lumen output. Utilization of multiple smaller LEDs reduces the size of the required optics for a given narrow beam angle.

In addition there is another benefit with the use of multiple smaller LEDs. The thermal impedance into which the heat flows is smaller for multiple sources in parallel than a single larger source. The thermal peak within the LED die is also reduced by spreading the thermal load over multiple smaller LEDs.

Interactive intelligent circuitry is defined as circuitry capable of dynamic collection of metrology under present conditions and responding to conditions to achieve a desired lumen output value. Interactive intelligent circuitry is capable but not limited to give optimum output for the different light outputs (Dim, Medium, and High)

Interactive Intelligent Driver for Thermal Control of Locomotive Headlight

Interactive intelligent circuitry can be defined as circuitry capable of dynamic collection of metrology under present conditions and responding to conditions to achieve a desired lumen output value. Interactive intelligent circuitry can be capable of, but not limited to, giving the optimum output for the different light outputs (Dim, Medium, and High) and simultaneously monitor the heat environment of the LED chips 12 for best conditions.

The Interactive Driver

The drive electronics can perform one or more of the following tasks: accept and operate with arbitrary input voltage polarity and connection, current limiting given wide input conditions, and the LEDs and driver are an electronic system with two types of parts: power and small signal.

Figure 13:
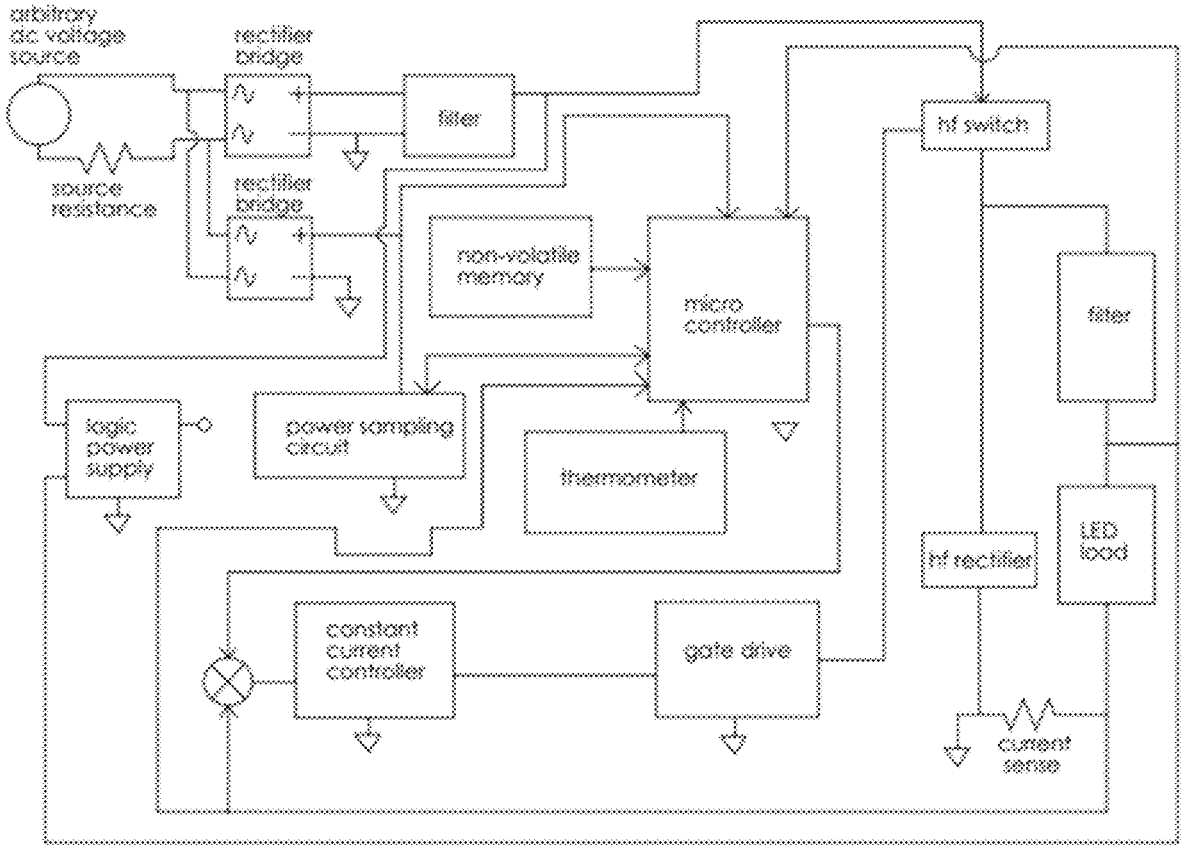
FIG. 13 illustrate a schematic of an exemplary LED driver top level in accordance with embodiments of the present invention.

Referring to FIG. 13, the drive circuitry is composed of two bridge rectifiers, one of which supply current to charge storage and the LEDs and other circuitry. The other of which is used to alter the input current in a momentary pulsed manner This has no charge storage so the pulse interval may be very brief for sampling the Thevenin equivalent of the circuit used to power the headlamp input terminals. It also may be pulsed for longer intervals to provide extra heat for melting ice and snow.

The control of the headlamp is achieved by a microprocessor which contains analog to digital conversion of a number of relevant voltages like those analogous to voltage in to the lamp, LED voltage for detection of out of tolerance condition, lamp current used for altering the control signal to the current controller. There exists a thermometer or sense element that may provide serial data, a voltage, or a pulse width or other signal to the controller that indicates the temperature of the metal core board to which it and the LEDs are mounted.

The control signal to the constant current controller is responsive to a signal generated by the micro controller. This signal is dependent on programming and various conditions sensed by the above.

In addition to the sensor data, the micro controller may respond to data as well as generate and save data to a non-volatile memory. This extends control of the LEDs to include configuration data as well as historical data that extends beyond the current interval in which it is powered continuously. Error conditions can be stored and communicated to the used by various optical patterns flashed on the output to indicate conditions within the lamp such as end of life. That data may be used as well to communicate to the manufacturer, information that may be of use in troubleshooting and further product development.

The use of a nonvolatile memory gives the lamp uniqueness for communication and other algorithmic requirements.

Since the input voltage is sensed by the micro controller, data may be written to the device by varying the input voltage pattern over time. This may be useful for post build configuration for a particular customer's requirement without the need for opening the device up. That configuration data may be stored and the device may exhibit the desired behaviors for that configuration.

The device may also communicate to the outside world via either the LED output in the form of patterns of flashes, or it may alternately pulse the Thevenin equivalent polling circuitry to alter the current drawn by the device. These current pulses may be converted and read by UART or other circuitry into various digital equipment for external use without opening the enclosure.

Accept and operate with arbitrary input voltage polarity and connection.

The incandescent lamp does not require defined polarity, whereas the LED retrofit drive can require a polar voltage input for the driver electronics. Given the absence of markings on the wiring harness to the lamp, a technician may not be able to nor inclined to determine polarity. A solution can be the placement of a diode bridge FIG. 13 "bridge rectifier" between the voltage source and drive electronics.

The LEDs can be stacked in series to provide reasonable operating voltage, and current and duty cycles to the controller and power parts. LEDs, are junction devices that have a low forward bias voltage.

The controller can be set to deliver maximum current. An analog voltage is supplied by the micro controller to a summing junction to simulate the remainder current in the control scheme. Any current from maximum to zero can be commanded with constant current controller.

The LEDs can be stacked in series to provide reasonable operating voltage, and current and duty cycles to the controller and power parts. LEDs are junction devices that have a low forward bias voltage. If this was designed in parallel instead of series, there would be unreasonable duty cycles and resolution degradation. Another problem of driving them in parallel is the variations in forward bias voltage that would cause large variations in drive current to the individual LEDs. Stacking them up in series to achieve a reasonable forward bias voltage with respect to the source voltage not only can provide for reasonable conduction times and levels, but can also take advantage of circuit and device parasitic resistance to properly split the current when paralleled with other stacks of LEDs operated on the same current controller.

The controller can be set to deliver maximum current. An analog voltage can be supplied by the micro controller to a summing junction to simulate the remainder current in the control scheme. Any current from maximum to zero can be commanded via this means shown in FIG. 13 "constant current controller".

Determine the series resistance of the voltage source to determine proper amplitude of the output current. This may be done through the existing two terminal connections 11 of FIG. 2.

This can be done by the micro controller sampling the run voltage input to the lamp and momentarily turning the lamp off and then sampling again the voltage. This method has two issues:

If there is any reactance in the source, the momentary cutting off of LED current could extend into a length that would be perceived as flicker by the human eye.

Sampling at a low current setting with the high voltage source and the small values of resistance in series with the lamp all add up to dropping the perceived signal level down to the noise margin. The required resolution of conversion would require more expensive and potentially unavailable parts.

Another more reliable way of sampling the series source resistance can be to keep the current steady on the LED load while periodically actuating another switch to momentarily cause a larger current to run through the supply through the LED lamp. This current can be set to an appropriate value via series resistors within the LED lamp enclosure. This eliminates the complexity and noise susceptibility of the previous means. The measurements of run voltage and run voltage with added extra current into the device are independent of output setting. Flicker is not a problem as the LED continues shining through the sampling process. This extra current will cause a momentary large power to be consumed by the LED luminaire. This can be minimized by reducing the frequency of sampling to a tolerable level that will not seem too unresponsive for the user.

An important feature of the design can be the sampling must continually be checked to recognize if any new power input command has been applied to the level switch. Limiting the power dissipated by this process is done by limiting the on time to an absolute minimum. The effective power dissipation can be small compared with the LED output. This time can further be minimized by adding an extra bridge that is outside of the capacitive energy storage required for the current mode control FIG. 13 "bridge rectifier". This eliminates the requirement that the sampling network drain off stored energy and the need to handle the extra power that time implies. Effectively the input power is split into one path for the LEDs to use and another unfiltered connection for the resistance sampling means. This results in very small on times for the sampling current and very small power dissipation for same. The switch and series resistance must be chosen for the worst case pulse currents and capable of moving heat out and operating under worst case conditions.

Figure 14:
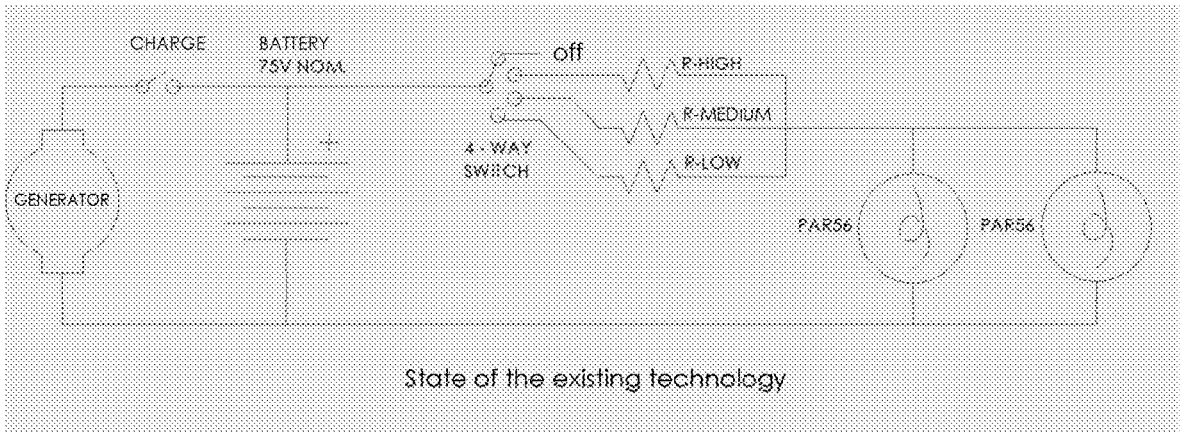
FIG. 14 illustrates a schematic of an exemplary PAR56 Incandescent (Quartz Halogen) lamp that can be used in accordance with embodiments of the present invention.

Since the typical connection of a train headlamp is two lamps in parallel off of a single voltage source FIG. 14 and single level setting series resistor, there arises the possibility of the two LED luminaires confusing the readings done by each to determine the external series resistance common to both. When both lamps are sampling at the same time false readings can occur. The devices are controlled by crystal clock source, and that overlap is likely as both will take a similar time to boot up into operation from the power up event. Since they are running the same code, they will sample at the same time interval, fouling one or both measurements.

This sampling overlap can be largely eliminated by making each unit unique by the storage of a unique number in each unit in nonvolatile memory that will control a delay in the initiation of the sampling intervals. Each device can be sampling at the same frequency, but at a different phase. This is aided in the relatively short sample time and relatively long sampling interval. Many unique delays can be accommodated. Even so, there is always the problem of accumulated timing error over time with small variations in clock frequency. If a timing error should occur, the code is implemented to randomize and re-start the delays that establish the phase relationship instead of entering a period of time where overlaps will be increasingly common. The self-correcting of errors will be continuous and give trouble free operation of the lamps.

Determine various out of tolerance conditions that would cause imminent failure or reduced life of the various components within the luminaire and act accordingly to prevent same.

There are many out of tolerance conditions that require a change in operation of the device to survive those conditions and return to normal operation once those conditions are removed. Most difficult of the out of tolerance conditions is the thermal limitations. The LED die have a maximum operable junction temperature. Other active and passive electrical devices share similar thermal limitations. The micro controller chosen can sense temperature, and/or read a temperature from an external circuit element. This can be used to scale back the power used in the device to a safe level until the thermal condition is remedied.

Another out of tolerance condition that may cause eventual failure is under and over voltage applied to the luminaire. Locomotive may be categorized as being "automotive" devices that rely on power applied to and from batteries by generators via switches. These switches produce high amplitude short duration spikes on the power rail. This is particularly detrimental for semiconductors which will cause a break over and failure in microseconds under this type of abuse. The fix can be to grossly overrate the power parts touching those voltages. This can be an element of the design.

This power rail is not a regulated source and may apply a persistent and detrimental over-voltage to the LED luminaire. Over time, the extra power dissipated in the current controlling switch may cause failure and should not be allowed to continue. In the case of an under voltage, the required currents to maintain the power output could cause overheating and early failure in the rectifying element of the converter and bridge.

Success of limiting early failure of components the micro controller (particularly the inputs and outputs) samples the input voltage and makes decisions responsive to those conditions by limiting or eliminating output to survive those conditions and maximize LED lamp life.

The LEDs and drive are an electronic system with two types of parts: power and small signal.

The power parts like LEDs, input rectifiers of the driver, driver switches, resistor sense network and the small signal boot supply. These components are best hosted on a metal core printed circuit board (MCPCB) 14. The aluminum MCPCB provides the best heat spreading and path.

The small signal components are more complex and interconnect becomes a problem on the MCPCB due to practical layer limitations and copper thickness requirements. The solution can be a standard printed circuit board that is supported off the MCPCB and interconnected via surface mount through-hole male headers that supply both signal and power paths and mechanical support to the fiberglass PCB 13. Since this is parallel to the optical plane and in the direction of the optical path, the small signal PCB may be perforated with one or more holes to allow for light from the LEDs to exit and be collected by the reflectors (FIG. 6). The conformal heat sink in FIG. 9 shows the heat sink outside the reflector with a heat path to the front of the headlight housing. This packs the control electronics into the empty space between the reflectors and provides dense packing with the benefit of only a single enclosure satisfying the requirements for environmental integrity. It also provides thermal coupling between the heat sensing element in the electronics and the LED junctions. This packing of components can provide for an unfettered heat path from the MCPCB to the aluminum enclosure on the opposite side of the optical path, out to external environment.

Thermal Control With Metal to Metal Contact

Details of Metal to Metal Conduction

Enclosure/heat sink—the enclosure may be configured to keep weather and/or external pollution out of the optics and electronics, as well as provide a path for heat into the outside environment.

A) The enclosure can provide mechanical support for one or more of the power entry, drive electronics, optics, and output window. It should fit within, and mate to, fixtures that accept standard PAR56 lamps. It can do so by its physical configuration and assembly of a variety of shaped materials.

B) The enclosure can be a way of power entry without exchange of gasses or fluids beyond the barrier. It can do so by a conductor insulated with gaskets and adhesives and supported by an insulating spacer and hardware. It can be configured to deliver input power to the drive electronics within the enclosure.

C) The enclosure can provide a way for optical energy egress without exchange of gasses or fluids beyond the barrier. This can be achieved by a glass window held in place by mounting rings and/or sealed by a gasket. It can be rugged enough for the weather and/or pollution extremes. It can also play a part in heat management.

D) The enclosure can provide a way for heat removal from the sensitive electro-optical components. The removal of large portion of the thermal load can be accomplished by enclosure of cast aluminum. The current arrangement is, but not limited to, two aluminum castings thermally coupled to perform as a single metal structure for the transfer of heat. The shape of the casting can be determined by mechanical requirements of one or more of the optics, drive electronics and the various means of transferring heat into the external environment.

The mating surface can utilize a gap filling mixture of particulates suspended in a flow medium between the front and back halves of the fixture in FIG. 4. This gap filler can provide the purposes of thermal coupling between the two halves and sealing out gas and liquid migration across its barrier. The enclosure of which is constructed in pieces each mating to one or more of its counterparts. These mating surfaces can have extended surface area to facilitate thermal coupling, and sealing without a gasket.

Heat can be moved away from the optics and electronics through their mechanical mating to the enclosure's interior surface. Heat can then travel, along the enclosure, to all parts of the contiguous metal. The most direct heat path can be out the bottom of the lamp enclosure to the metal to air interface surface. The current arrangement is, but not limited to, pins for the dissipation of heat which can allow for unrestricted position during operation. The pin heat dissipation surface can be configured to maximize air contact at arbitrary rotary orientations FIG. 12 (with the beam axis is parallel to the locomotive train tracks) about the beam axis. This places the base of the enclosure perpendicular to the tracks and parallel to the convection path of heated air. Heat removal by convection is maximized by these pins adding surface area with which the air interacts. The pins can be no longer than the rear profile 5 of the PAR56 Incandescent (Quartz Halogen) lamp.

The aluminum enclosure may be anodized to increase emissivity and increase the effect means of heat transfer to the external environment. This flow of thermal energy from the internal portion of the lamp enclosure is limited by thermal capacity of the locomotive fixture because the fixture of the locomotive is not vented to external environment. The enclosure can dissipate heat until it is in equilibrium with the locomotive fixture. To avoid this limitation of thermal capacity another direction for heat removal can be to separate the electronics. The lower heat generating electronics and optics can be moved forward to provide for maximum heat spreading around the outlying LED dies and to provide for a heat path into the external air by extending the enclosure into the unobstructed space in the beam path. The wall of the enclosure can have pins to maximize interaction with the outside air especially enhanced by the motion of the locomotive.

CPC and Antireflective Coating on Glass Plate

The present invention can includes all forms of reflectors including the CPC (Compound Parabolic Concentrator) 16 has the function to collect the light from the LED die and send the light forward through the protective glass lens or plate. Glass lens (aspheric) or plate 17 can have the ability to reflect approximately 4% to approximately 8% (depending on lens or plate) of the light back from each glass air interface surface to the LED die, so a possible variation can be the use of anti-reflective coating on the glass surface to pass the light forward through the protective glass lens or plate. Using a broadband anti-reflective coating can reduce surface reflection of a surface from approximately 4% to less than approximately 0.5%

Structural Protective Ring

Structural Protective Ring is another object to provide structural protection using a structural protective ring that protects lamp from side impact. Protective structure surrounding the exterior portion of the lamp enclosure can be an integral part of the cast aluminum heatsink or can be an added feature mounting to the heat sink casing with fasteners. There should be enough height to the ring to protect the lenses from any side impact. The ring (collar) 18 should be thick enough to withstand the impact. In order to compensate for the added weight cut away of material 19 may be removed without loss of protection from side impact. Cutaways can be slots, ovals, circles 19 or grooves.

Possible structural variations of the protective ring can include the use of concentric rings to give further protection that can absorb energy from a side impact.

Interactive communication in the present invention utilizes three methods of communication. First level of communication is the error condition codes that can be output to human observers by flashing the LEDs upon starting the LED retrofit. This occurs when conditions are out of the normal range, at periodic intervals or when prompted via other communication means. Second, data such as, but not limited to, error conditions, configuration parameters, calibration data, can be placed on the power line. This develops a data sequences encoded on the power rail via current variations through the series source impedance. This data may be read by small signal devices through ac coupling that data stream to the small signal device. Third, is wireless communication for data exchange from the LED retrofits. This can also be used for out of normal condition alerts and data exchange.

Upon initial startup data communication is needed for calibration and diagnostics, the LED retrofit lamp must sense the values of existing locomotive resistors in series and calculate the correct power conditions through information derived from two terminal connections. The sensing is autonomous and asynchronous through timing differences generated by a unique number within the stored data of each fixture. Detection of data collision and correction is done within each lamp and steps are taken to remedy the data conflicts. The ability to communicate with other LED retrofits allows for the exchange of data between LED retrofit lamps to adjust to any conditional changes that could affect performance. This feature incorporates the ability to compensate for lamp failure in the four headlight network and raise the output of existing lamp to compensate for lost output.

In addition there is another benefit with the use of multiple smaller LEDs. The thermal impedance into which the heat flows is smaller for multiple sources in parallel than a single larger source. The thermal peak within the LED die is also reduced by spreading the thermal load over multiple smaller LEDs.

Details of LED Enclosure

The enclosure may be configured to keep weather and/or external pollution out of the optics and electronics as well as providing a path for heat into the outside environment.

FIG. 2 illustrates a cutaway upper perspective view of the LED lamp enclosure demonstrating the external components optical lens 17, and power terminals 1. Internal components LED die 12, LED die mounted on the metal core printed circuit board for thermal conduction, small component printed circuit board 13, conductive metal housing 15, and the reflector 16.

In FIG. 2, the enclosure must provide mechanical support for the power entry 11, drive electronics 12 and 13, reflector optics 16, and output window 17. The enclosure must fit within and mate to fixtures that accept standard PAR56 lamps. The enclosure does so by its physical configuration and assembly of a variety of shaped materials.

The enclosure must provide a means of power entry without exchange of gasses or fluids beyond the barrier. FIG. 2 shows power entry utilizing a conductor 11 insulated with gaskets and adhesives and supported by an insulating spacer and assorted hardware. It delivers input power to the drive electronics within the enclosure.

The shape of the casting is determined by mechanical requirements of the optics, drive electronics and protective structure on the exterior portion of the enclosure. The protective structure 18 comprises a ring or concentric rings FIG. 5 that protect against side impact to the exterior portion of the enclosure.

FIG. 2 shows a cutaway upper perspective view of the metal headlight housing showing the LED die 12, reflector 16 and the optical lens 17. In FIG. 2, the enclosure must provide a means of optical energy egress without exchange of gasses or fluids beyond the barrier. This is achieved by a glass window 17 held in place by mounting rings and sealed by a gasket. It must be rugged enough for the weather and pollution extremes. It also plays a part in heat management.

The enclosure must provide a means of heat removal from the sensitive electro-optical components. The removal of large portion of the thermal load is accomplished by enclosure of cast aluminum. In FIG. 4 the current arrangement is, but not limited to, two aluminum castings thermally coupled to perform as a single metal structure providing various means of transferring heat into the external environment.

In FIGS. 4 and 9 demonstrate with arrows the general pathway for heat removal. Heat is moved away from the optics and electronics through their mechanical mating to the enclosure's interior surface. Heat then travels along the enclosure to all parts of the contiguous metal. The most direct heat path is out the bottom of the lamp enclosure to the metal to air interface surface. The current arrangement is, but not limited to, pins for the dissipation of heat which allows for unrestricted position during operation. The pin heat dissipation surface is configured to maximize air contact at arbitrary rotary orientations (with the beam axis is parallel to the locomotive train tracks) about the beam axis. This places the base of the enclosure perpendicular to the tracks and parallel to the convection path of heated air. Heat removal by convection is maximized by these pins adding surface area with which the air interacts. The pins are no longer than the rear profile 5 of FIG. 1 of the Incandescent (Quartz Halogen) PAR56 lamp.

The aluminum enclosure may be anodized to increase emissivity and increase the effect means of heat transfer to the external environment. This flow of thermal energy from the internal portion of the lamp enclosure is limited by thermal capacity of the locomotive fixture because the fixture of the locomotive is not vented to external environment. The enclosure will dissipate heat until it is in equilibrium with the locomotive fixture. To avoid this limitation of thermal capacity another direction for heat removal is to separate the electronics. The lower heat generating electronics and optics are moved forward to provide for maximum heat spreading around the outlying LED dies and to provide for a heat path into the external air by extending the enclosure into the unobstructed space in the beam path. The wall of the enclosure has pins to maximize interaction with the outside air especially enhanced by the motion of the locomotive.

In an embodiment of the invention, a set of multiple LEDs, optics and drive electronics that is in an enclosure designed to move heat out into the environment.

In an embodiment of the invention, a luminaire as described in whose enclosure extends out along the optical path into the external air. This is to provide for greater heat transfer into the environment than a typical bowl whose window is nearer the bulkhead mount. This heat is transferred by this extension mainly by convection and radiation.

In an embodiment of the invention, a luminaire as described in whose LED emitters and drive electronics are hosted on two boards, one power printed circuit board which contain the LED emitters and the power drive electronics for unified heat management, and another small signal printed circuit board containing the control electronics.

In an embodiment of the invention, a luminaire as described in whose small signal components of the drive electronics are integrated onto additional layers of the power printed circuit board, thus eliminating the extra PCB and its interconnect.

In an embodiment of the invention, a small signal logic as described may contain a) Micro controller, b) Analog to digital conversion means, c) Digital to analog means, d) Nonvolatile data memory for code storage and execution, e) Nonvolatile data storage for storing calibration data, f) Nonvolatile data storage capability for on the fly data collection, g) Constant current controller responsive to said micro controller for modulating load current, h) Current switching means to add current load for source resistance calculation, i) Inputs to item b include: i) Input Voltage, ii) LED run voltage, iii) LED run current.

In an embodiment of the invention, current switching means as described in h) isolated from input filter reactance.

In an embodiment, the micro controller then sets the appropriate run current.

In an embodiment of the invention, the sampling data is repeated to constantly monitor the input setting.

In an embodiment of the invention, the sampling interval of 8 is shifted to avoid collisions from others of its kind via a unique identifier stored in e). In case of spurious command generated by colliding (overlapping in time) samples, the unique delay is re-generated with on board non-deterministic data, thus avoiding repeated collisions.

In an embodiment of the invention, sampling interval of 8 is large compared to the sampling time to allow for: lower power dissipation in sampling, a tendency to avoid sampling collisions, a large number of potential unique data values controlling the phase at which samples are taken.

In an embodiment, a luminaire as described whose drive electronics are packed between the multiple LED emitters off of the heat sink in the direction of the optical path compared to the heat sinking components. This allow for a dense packing in a single enclosure that does not compromise the major heat path out the back of the LED package into the heat sinking component (enclosure).

In an embodiment, a luminaire as described above which is sealed from the external environment.

In an embodiment, a luminaire may replace the typical trapped air, with an optically clear fluid whose thermal capacity and thermal conductivity is greater than air. This provides a greater heat path to the front window, which is the surface that sees the most air movement. This enhances the efficiency of the heat transfer means in the direction of the optical path.

In an embodiment, a luminaire as described whose internal fluid medium has a volume of gas to compensate for the thermal expansion of the internal fluid medium.

In an embodiment of the invention, a luminaire as described whose gas is trapped in a flexible expanding/contracting deformable bladder or other device. This avoids the potential of bubbles of gas interfering with the optical output.

In an embodiment of the invention, a luminaire as described which uses the LED output to signal out of tolerance or error conditions under power up or a triggering condition provided via the input power means.

In an embodiment of the invention, a luminaire as described whose power source sampling means may be used to signal data out to a monitoring device or other luminaires via the input power lines.

In an embodiment of the invention, a luminaire as described responsive to out of tolerance or error conditions may alter the light output to affect the safety and continued operation of the luminaire.

In an embodiment of the invention, a luminaire as described may communicate data collected to the outside world with the flashing of the output LEDs upon external prompt or a preset condition.

In an embodiment of the invention, a luminaire as described may communicate to other luminaire with same features. Data transmitted through pulsing currents on the power lines to other luminaires. The pulsed currents will develop a serial sequence of voltages that may be read by digital means both internal and external to the luminaire. This communication shall be bi directional in a half-duplex fashion. Also communication may be extended to full duplex via frequency shift encoding/decoding whose frequencies are determined by stored data uniqueness. The information can also be transmitted and received through wireless communication between luminaires and also to receiver external to the locomotive.

In an embodiment of the invention, foams, sponges or expanded materials made of thermally conductive; metals, Graphene, Carbon Nanotube, Pyrolytic carbon, Graphite or combination of any of these materials can be utilized for the removal of thermal energy from Light Emitting Diodes in locomotive headlight.

In an embodiment of the invention, a luminaire as described with external features and structure is optimized for greater surface area with intended purpose of moving heat into the surrounding environment, and whose structure is insensitive to mounting orientation rotation along the optical axis.

What has been described and illustrated herein are various embodiments. The terms, descriptions and Figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

The invention claimed is:

1. A luminaire comprising:

a plurality of light emitting diodes (LEDs);

a circuitry comprising optics including a plurality of reflectors and drive electronics including a power circuit board; and an enclosure configured to house the plurality of LEDs and the circuitry, the enclosure configured to transfer heat from the plurality of LEDs and the circuitry out of the enclosure and into a surrounding environment, wherein the plurality of LEDs are mounted to the power circuit board disposed at a back of the enclosure, wherein the plurality of reflectors are mounted to the power circuit board within the enclosure such that each reflector of the plurality of reflectors is configured to reflect and direct light emitted by one or more LEDs of the plurality of LEDs and dissipate heat generated by the one or more LEDs, wherein an LED output signal from the one or more LEDs is output to the circuitry so as to monitor an error condition, an out of tolerance condition or a triggering condition of the one or more LEDs, and wherein the circuitry is configured to communicate pulsing currents to an outside electrical system, wherein the pulsing currents develop a serial sequence of digital voltages that are provided to the outside electrical system.

2. The luminaire of claim 1, wherein the plurality of LEDs have an optical path defined by the reflectors and wherein the enclosure extends longitudinally outward, along the optical path, into the surrounding environment, wherein the plurality of reflectors within the enclosure provide heat transfer into the surrounding environment.

3. The luminaire of claim 1, wherein the heat is transferred to external environment by conduction, convection and radiation.

4. The luminaire of claim 1, wherein heat is transferred from each LED in the plurality of LEDs (i) through a forward heat sink, (ii) through the enclosure, and (iii) through a rear heat sink, wherein the forward heat sink and the rear heat sink each comprise a plurality of pins.

5. The luminaire of claim 1, further comprising:

a small signal printed circuit board containing control electronics, the small signal printed circuit board being mounted to the power circuit board.

6. The luminaire of claim 5, wherein the small signal printed circuit board is integrated to the power circuit board.

7. The luminaire of claim 6, wherein the small signal printed circuit board includes power drive electronics and the power drive electronics of the small signal printed circuit board are disposed between adjacent LEDs.

8. The luminaire of claim 7, wherein the power drive electronics and the plurality of LEDS are densely packed in the enclosure without compromising major heat path out a back of the plurality of LEDs into the enclosure.

9. The luminaire of claim 1, wherein the enclosure is sealed from surrounding environmental elements.

10. The luminaire of claim 1, wherein the enclosure has protrusions having a surface area configured to move heat into the surrounding environment.

11. The luminaire of claim 1, further comprising a structural protective ring configured to protect the luminaire from side impact.

12. The luminaire of claim 11, wherein the structural protective ring surrounds an exterior portion of the enclosure.

13. The luminaire of claim 12, further comprising a cast aluminum heat sink and wherein the structural protective ring is 1) an integral part of the cast aluminum heat sink or 2) an added feature mounted to the cast aluminum heat sink with fasteners.

14. The luminaire of claim 11, wherein the structural protective ring has a height configured to protect a lens of the luminaire from a side impact.

15. The luminaire of claim 11, wherein the structural protective ring has a thickness configured to withstand a side impact.

16. The luminaire of claim 11, wherein the luminaire has cutaways configured to compensate for an added weight of the structural protective ring, wherein the cutaways are one or more of slots, ovals, circles and grooves.

17. The luminaire of claim 1, further comprising a conformal heat sink for heat transfer, wherein the conformal heat sink is arranged thermally in contact with said each reflector so as to transfer heat through the enclosure to external ambient air.

18. The luminaire of claim 1, wherein, a light output of the plurality of LEDs diminishes over time and is counterbalanced with incremental increases of electrical power delivered through the power circuit board to maintain an operational candela requirement, wherein a controlled increase of the electrical power also controls a heat load on the luminaire.

19. The luminaire of claim 1, wherein the circuitry includes a small signal logic circuit comprising at least one of a microcontroller, control logic equivalent, analog to digital converter, digital to analog converter, nonvolatile data memory for code storage and execution, nonvolatile data storage for storing calibration data, nonvolatile data storage capability for real time data collection, constant current controller responsive to the microcontroller for modulating load current, or a current switching device to add current load for source resistance calculation.

20. The luminaire of claim 19, wherein the circuitry includes the analog to digital converter, wherein inputs to the analog to digital converter include input voltage, LED run voltage, LED run current and a temperature sensing element.

21. The luminaire of claim 1, further comprising a power source sampling device to signal data out to a monitoring device or to other luminaires via input power lines, the power source sampling device configured to generate extra heat for melting at least one of ice and snow.

22. The luminaire of claim 1, wherein in response to the out of tolerance condition or the error condition, the circuitry alters light output of the one or more LEDs to affect safety and continued operation of the luminaire.

23. The luminaire of claim 1, wherein the circuitry is configured to collect data associated with an operation of the one or more LEDs and communicate the data collected to the outside electrical system.

24. The luminaire of claim 1, wherein the circuitry is electrically connected to the outside electrical system using power lines and collected data is communicated using the pulsing currents on the power lines to the outside electrical system.

25. The luminaire of claim 1, wherein communication of the pulsing current by the circuitry to the outside electrical system is bi directional in a half-duplex fashion or extended to full duplex via frequency shift encoding/decoding whose frequencies are determined by stored data uniqueness.

* * * * *